US007407341B2

(12) United States Patent
Yodock, Jr. et al.

(10) Patent No.: US 7,407,341 B2
(45) **Date of Patent: *Aug. 5, 2008**

(54) FLOATING BARRIER WALL

(76) Inventors: Leo J. Yodock, Jr., 623 NE. 5th Ter., Fort Lauderdale, FL (US) 33304; Leo J. Yodock, III, 2832 Cleveland St., Hollywood, FL (US) 33020; Guy C. Yodock, 623 NE. 5th Ter., Fort Lauderdale, FL (US) 33304

( * ) Notice: Subject to any disclaimer, the term of this patent is extended or adjusted under 35 U.S.C. 154(b) by 100 days.

This patent is subject to a terminal disclaimer.

(21) Appl. No.: 11/320,382

(22) Filed: Dec. 28, 2005

(65) Prior Publication Data

US 2007/0031193 A1 Feb. 8, 2007

Related U.S. Application Data

(63) Continuation of application No. 10/119,130, filed on Apr. 2, 2002, now abandoned.

(51) Int. Cl.
*E02B 15/06* (2006.01)

(52) U.S. Cl. ..... 405/70; 405/63

(58) Field of Classification Search ..... 405/23, 405/26, 60, 61, 63, 65, 66, 67, 70, 71, 72; 404/6, 9; 114/240 R, 240 C, 240 D, 240 E; 256/13.1

See application file for complete search history.

(56) References Cited

U.S. PATENT DOCUMENTS

| | | | | |
|---|---|---|---|---|
| 3,685,297 | A | 8/1972 | Juodis et al. | 61/1 F |
| 4,043,131 | A * | 8/1977 | Sessions | 405/70 |
| 4,059,362 | A | 11/1977 | Smith | 404/6 |
| 4,391,077 | A | 7/1983 | Giess | 52/586.2 X |
| 4,406,241 | A * | 9/1983 | Comte | 405/215 |
| 4,543,012 | A | 9/1985 | Riley | 405/71 |
| 4,681,302 | A | 7/1987 | Thompson | 256/13.1 |
| 4,715,307 | A | 12/1987 | Thompson | 114/65 A |
| 4,773,629 | A | 9/1988 | Yodock | 256/13.1 |
| 4,946,306 | A | 8/1990 | Yodock | 404/6 |
| 5,006,014 | A * | 4/1991 | Greenough | 405/72 |
| 5,123,773 | A | 6/1992 | Yodock | 404/6 |
| 5,152,636 | A | 10/1992 | Myers | 505/68 |
| 5,355,825 | A | 10/1994 | Lefebvre et al. | 114/267 |
| 5,439,315 | A | 8/1995 | MacKenzie et al. | 405/60.5 |
| 5,498,101 | A | 3/1996 | Braverman | 404/6 |

(Continued)

FOREIGN PATENT DOCUMENTS

| | | |
|---|---|---|
| CH | 679227 | 1/1992 |

(Continued)

*Primary Examiner*—M. Safavi
(74) *Attorney, Agent, or Firm*—GrayRobinson, PA

(57) ABSTRACT

A floating barrier wall includes a number of individual barrier units each comprising a housing formed in the general shape of a highway barrier having a top wall, a bottom wall, opposed end walls, and, opposed side walls interconnected to form a hollow interior which is preferably partially or completely filled with a foam material. A ballast weight is secured to each barrier unit, either along or beneath the bottom wall, to maintain them in an upright position in the water. Cables, couplers and/or other connectors are employed to mount adjacent barrier units end-to-end to form a barrier wall which can encircle a vessel or otherwise isolate an area within a seaport to provide security.

16 Claims, 12 Drawing Sheets

U.S. PATENT DOCUMENTS

| | | | | |
|---|---|---|---|---|
| 5,531,413 | A | 7/1996 | Wassterstrom et al. | 404/6 |
| 5,605,413 | A | 2/1997 | Brown | |
| 5,875,729 | A | 3/1999 | Simola | 114/267 |
| 5,882,140 | A | 3/1999 | Yodock | 404/6 |
| 2004/0115002 | A1 | 6/2004 | Meeks et al. | 405/60 |

FOREIGN PATENT DOCUMENTS

| | | | |
|---|---|---|---|
| DE | 25 33 913 | A | 2/1977 |
| GB | 2 250 720 | A | 6/1992 |

* cited by examiner

FLOATING BARRIER WALL

This is a continuation of application(s) Ser. No. 10/119,130 filed on Apr. 2, 2002 now abandoned which claims priority under 35 U.S.C. §120

FIELD OF THE INVENTION

This invention relates to a barrier system for the protection of vessels and other assets located in or around bodies of water, and, more particularly, to a floating barrier wall constructed of a number of individual barrier units each formed of a light weight plastic having a hollow interior at least partially filled with a foam material, a ballast weight mounted at, near or within the base of the unit to maintain it in an upright orientation in the water, and, cables or other structure to connect adjacent barrier units end-to-end to form the barrier wall.

BACKGROUND OF THE INVENTION

The security of vessels, both military and commercial, as well as other assets located in and around seaports, has been of increasing concern in the wake of activities by terrorists and others. Most security efforts have focused on potential land-based attacks, and little attention has been devoted to the provision of an effective deterrent to assaults from floating objects, vessels or other water-based threats.

A vessel anchored at port to take on fuel or supplies is particularly vulnerable to attack. Although radar, sonar and other sensors can remain active and manned during these periods, no evasive action could be taken in a short period of time to avoid a water-born attack. One option for military vessels is to remain on alert while anchored, with guns manned, but in busy seaports it may be difficult to discern between harmless commercial traffic and a potential attacker. At present, there is no system which is visible in the water for effectively defining an area of restricted access and to warn other vessels to stay away from a military or commercial ship at anchor. Buoys, channel markers and the like which are commonly found in the water at seaports are not suitable for use as a warning device because they have not historically been used for such purpose and would not be perceived in that way by vessel operators. As a consequence, it is conceivable that an innocent commercial vessel could be fired upon by an anchored military ship for entering restricted space defined by buoys or other markers because the vessel operator did not realize the buoys or markers were being used for that purpose.

SUMMARY OF THE INVENTION

It is therefore among the objectives of this invention to provide a system for water-based security of vessels and other assets located at seaports which effectively warns other vessels of the presence of a restricted area, which impedes or stops the progress of at least smaller vessels attempting to enter a restricted area, which is portable and easily deployed around a ship or other assets and which can withstand conditions at sea.

These objectives are accomplished in a floating barrier wall including a number of individual barrier units each comprising a top wall, a bottom wall, opposed end walls, and, opposed side walls interconnected to form a hollow interior which is partially or completely filled with a foam material. A ballast weight is secured to each barrier unit, to maintain them in an upright position in the water. Cables, couplers and/or other connectors are employed to mount adjacent barriers end-to-end to form a barrier wall which can encircle a vessel or otherwise isolate an area within a seaport to provide security.

This invention is predicated upon the concept of creating a floating wall of interconnected barrier units which can be readily recognized by operators of vessels and others as a warning structure delineating a restricted area. In the presently preferred embodiment, the individual barrier units are a modified version of plastic structures which have been conventionally used as highway barriers of the type disclosed, for example, in U.S. Pat. No. 5,882,140. Each barrier is formed in the general shape of a "New Jersey" style concrete highway barrier, with side walls having a curb reveal extending vertically upwardly from the relatively wide bottom wall, an angled section extending inwardly from the curb reveal and a vertical section located between the angled section and top wall. Although not previously used in water-based applications, barriers of this shape are readily recognized as defining areas of restricted or no access. Additionally, an opening is formed in each barrier which is capable of mounting a sign, flashing light or other indicia to provide further warning and notice of an area which is off limits to traffic. Individual barrier units are connected end-to-end forming a continuous wall which can encircle or otherwise isolate vessels and other assets.

A number of features are included in the barrier units of this invention to adapt them for use in water security applications. In one embodiment, a rotational molding process is employed to combine crosslinkable high density polyethylene material with polyethylene foaming pellets to form the barrier unit with walls having an interior surface covered with a layer of foam. The plastic, polyethylene walls have a thickness on the order of about 0.25 inches, and the foam layer is in the range of about 0.5 to 6 inches in thickness depending upon the amount of foaming pellets used. In an alternative embodiment, substantially the entire hollow interior of the barrier is filled with foam material. Preferably, a liquid material is introduced into the hollow interior through one or more fill holes formed in the top wall of the barrier, and it then cures to form a foam which expands to fill all or a part of the entire volume of the barrier interior.

In order to maintain the barrier units in an upright position in the water, a ballast weight is provided which is mounted along or beneath the bottom wall, or within the interior or the barrier units. As described below, the bottom wall can be formed with a recess to receive the ballast weight so that it is substantially flush with the bottom wall. Alternatively, the ballast weight extends a short distance below the bottom wall of the barrier unit and is configured to create limited resistance to current, tides, wake and other water movement. Further embodiments of this invention employ ballast material located along the base of the barrier units within their hollow interior. In one preferred embodiment of this type, the bottom wall of each barrier unit is formed in the V-shaped configuration of a boat hull, and concrete or other heavy material is introduced into the interior of the barrier unit along the bottom wall to provide the ballast weight. Alternatively, the bottom wall of the barrier device is formed with spaced, hollow pontoons, each of which is filled with ballast material.

A number of designs are provided for attaching adjacent barrier units to one another to form a barrier wall. Each barrier unit is preferably formed with a pair of channels which extend through the hollow interior thereof from one side wall to the other. In addition, each end wall of the barrier units is formed with a recess configured to receive one end of a coupler element. In one embodiment, the barrier units are placed end-to-end, and then a coupler element is inserted within the abutting recesses of adjacent barriers to connect them together. An endless first strap, cable, chain or the like is looped around the channel of one barrier and the channel of an adjacent barrier to provide additional support for securing the barriers together end-to-end. Additionally, a second strap or cable may be extended from the first strap around the top wall of the barrier unit in position to overlie the coupler element and retain it in place within the recesses.

In addition to the connections described above to maintain adjacent barriers together, structure is employed to provide resistance to the passage of vessels or other objects travelling along the surface of the water from passing through the barrier wall into the restricted area it protects. In various embodiments, a continuous cable, chain or other elongated element is mounted to the side walls or top wall of the interconnected barrier units, and the opposite ends of the cable are connected to a permanent structure such as the pilings of a pier, dock or the like. The barrier wall carries the cable above the surface of the water in position to engage the hull of a vessel or other object moving along the surface of the water to stop, or at least impede, the progress thereof.

In one embodiment, a number of eyebolts are mounted to each barrier device in the area of the curb reveal which are spaced along the barrier side walls between the end walls thereof. The eye of each eyebolt receives and supports the cable in position approximately midway along the vertical height of the side walls. Alternatively, at least one sleeve is formed in each barrier unit, extending from the top wall toward the bottom wall thereof. Each sleeve, in turn, mounts an eyebolt which supports a cable in a position overlying the top wall of the barrier units. In either case, the cable(s) are maintained above the surface of the water and can be securely connected at their opposite ends to a fixed, land-based structure for maximum resistance to impact with a vessel or other object moving along the water.

In a still further embodiment, one or more conduits in the form of a pipe or tube are positioned within the interior of each barrier unit and extend longitudinally between the opposed end walls thereof. When the barrier units are placed end-to-end, the conduit of one barrier aligns with that of an adjacent barrier and a coupling device interconnects the two conduit ends. Preferably, the conduits also provide a support for adjustably mounting a ballast weight beneath the bottom wall of the barrier units.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
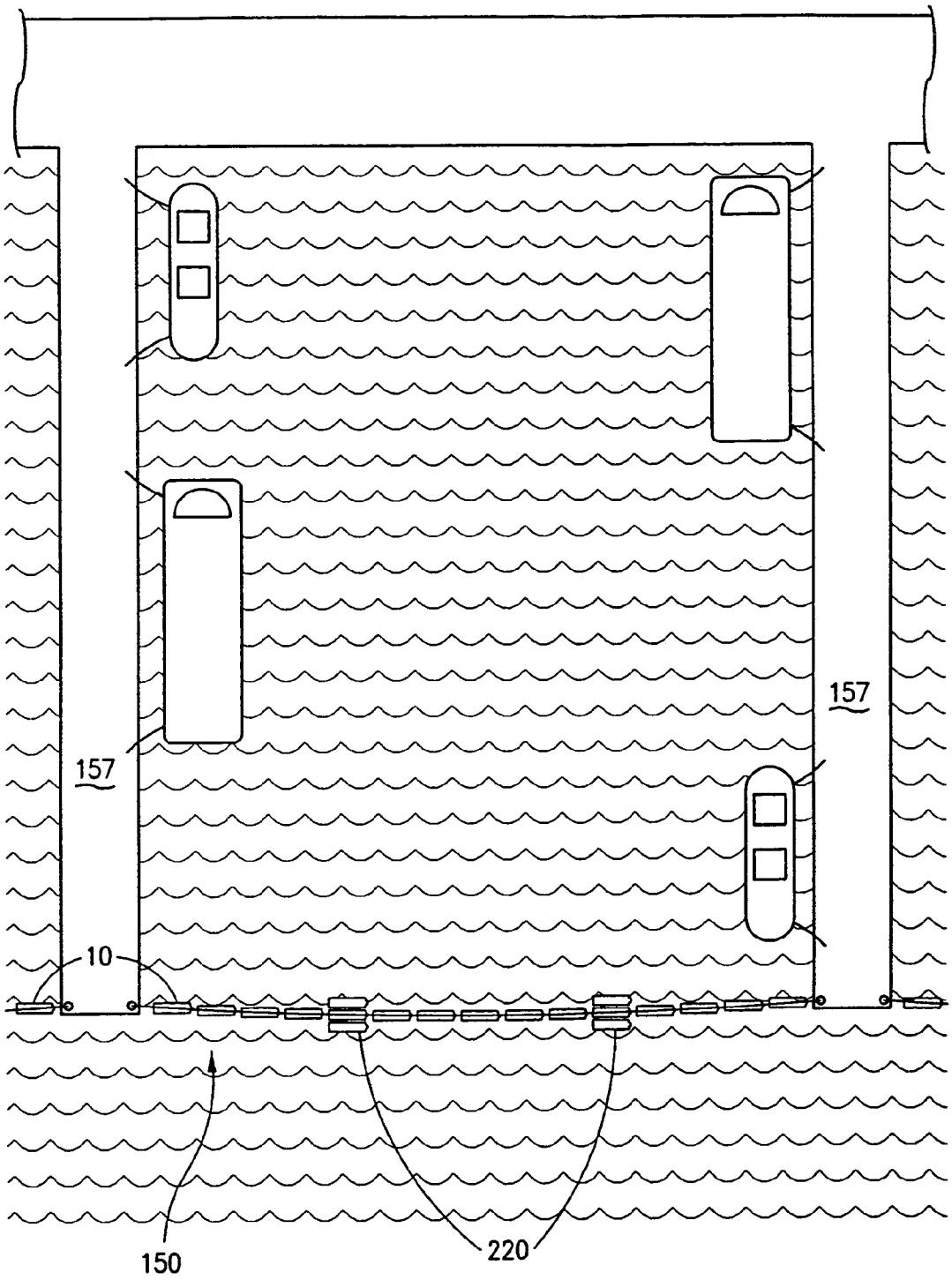
FIG. 1 is a schematic plan view of a representative installation for the barrier wall of this invention in which individual barrier units carry a cable whose ends are each anchored to a pier defining an enclosed body of water where vessels are moored.

A number of alternative embodiments of barrier units according to this invention are depicted in the drawings, and there are different means of interconnecting adjacent barrier units to form a barrier wall depending on their construction. Notwithstanding certain structural variations in the several embodiments of the barrier units herein, as discussed below, common elements are present in each of the preferred embodiments. The description which follows discusses each embodiment of the barrier units of this invention separately, with common structure identified with the same reference numbers in the Figs. The means for connecting adjacent barriers is also described separately below.

Barrier Unit of FIGS. 2-6

Figure 2:
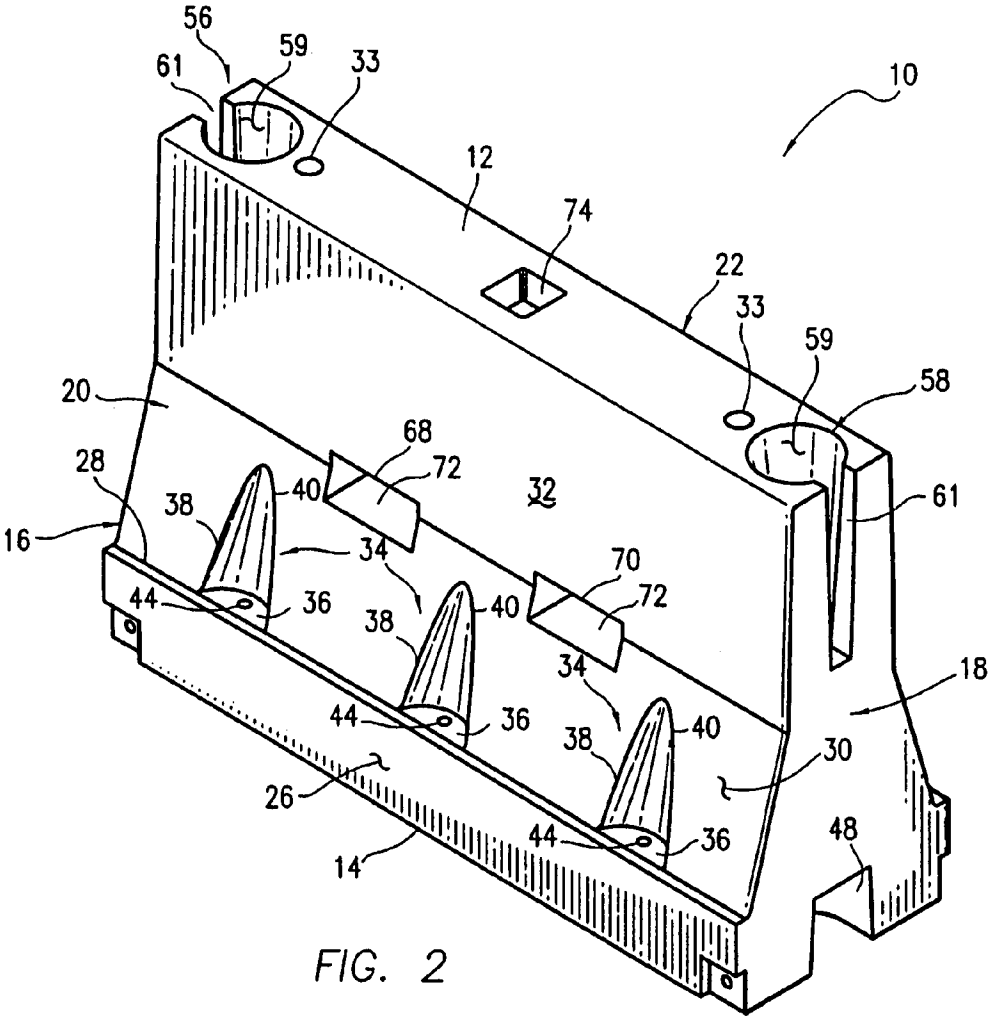
FIG. 2 is a perspective view of one embodiment of an individual barrier unit of this invention.
Figure 3:
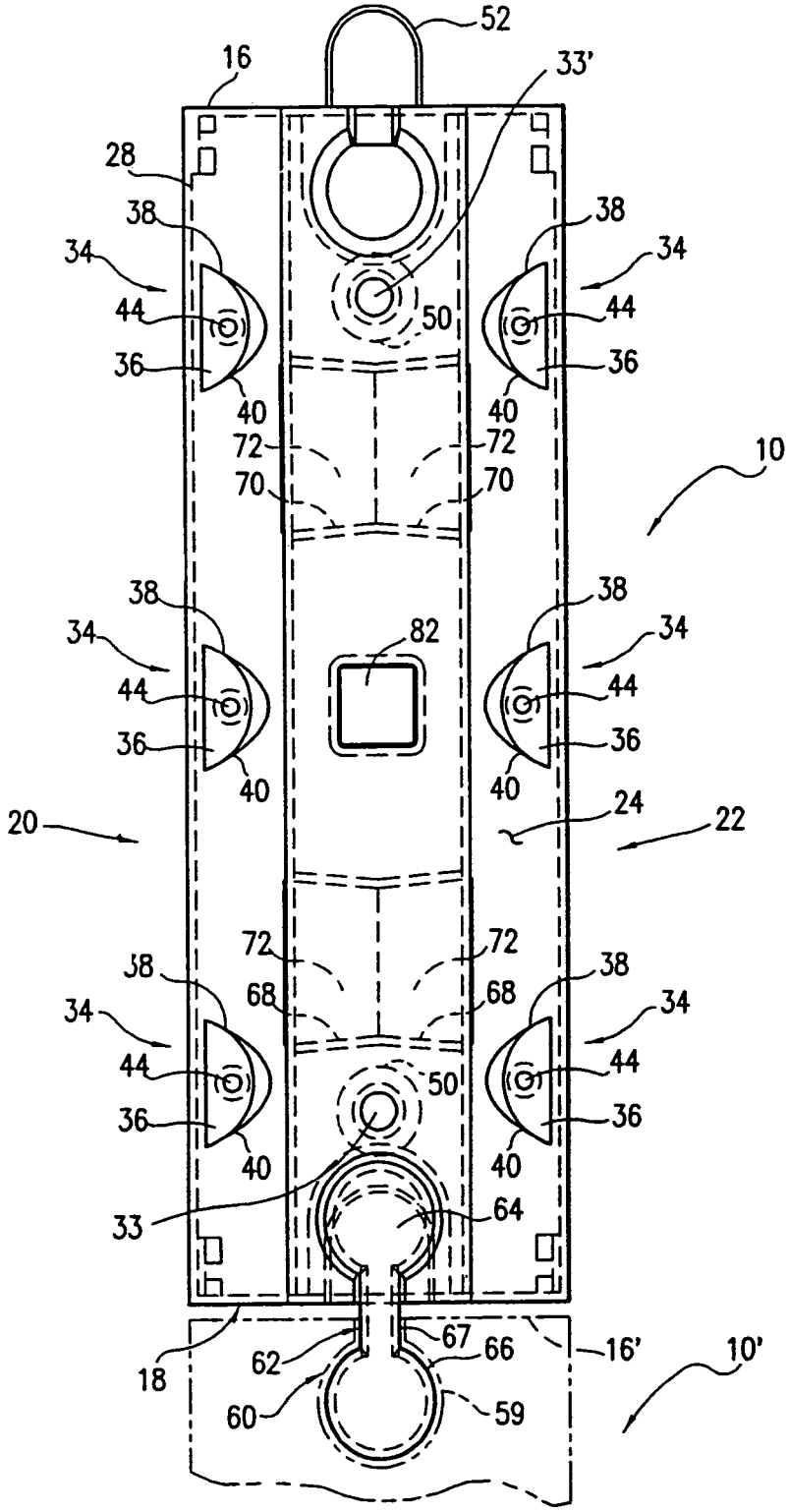
FIG. 3 is a plan view of the barrier unit depicted in FIG. 1, with a portion of a second barrier shown in phantom at one end.
Figure 4:
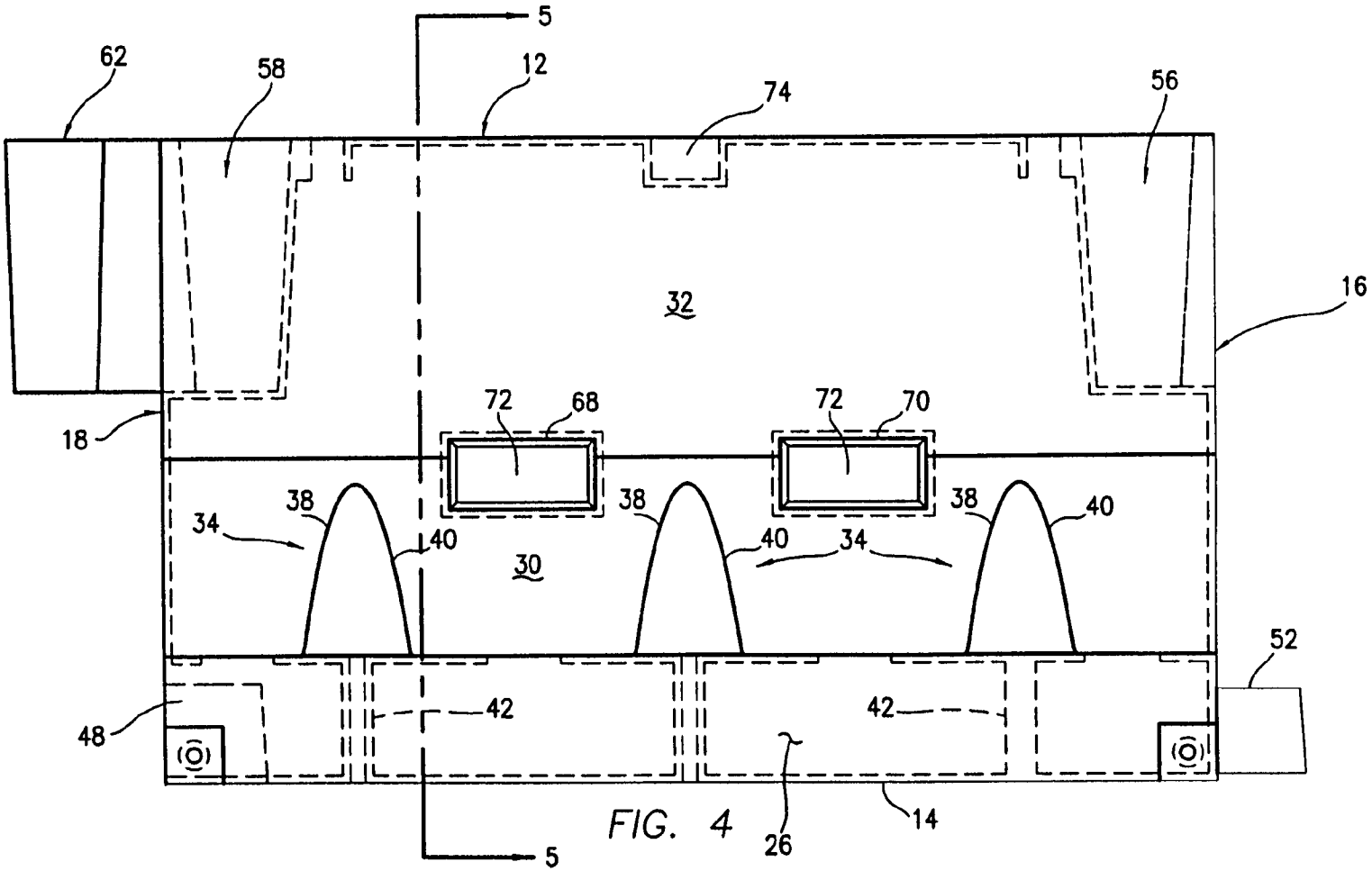
FIG. 4 is a side view of the barrier unit of FIG. 2.

Referring initially to FIGS. 2-4, each individual barrier unit 10 in this embodiment of the invention comprises a top wall 12, a bottom wall 14, opposed end walls 16, 18, and, opposed side walls 20, 22 which are interconnected to collectively define a hollow interior 24. In the presently preferred embodiment, each of the walls 12-22 are formed of a semi-rigid plastic material chosen from the group consisting of low density polyethylene, high density polyethylene, acrylonitrile or butadiene styrene, high impact styrene, polycarbonates and the like. These plastic materials are all inherently tough, exhibit good energy absorption characteristics are generally unaffected by weather and have excellent basic resistance to weathering, leaching and biodegradation. Materials such as ultraviolet inhibitors can be added thereto, making such materials further resistant to the effects of weather. They also retain their mechanical and chemical properties at low ambient temperatures.

In this embodiment, the walls 12-22 of barrier unit 10 have a thickness in the range of about one-eighth inch to one inch so as to perform satisfactorily in service, as described in more detail below. The barrier units 10 are preferably in the range of about six to eight feet in length, and, at the wall thickness noted above, have a weight when empty of about 75 to 130 lbs.

Considering initially the construction of the side walls 20, 22 of a barrier unit 10, since both are identical in configuration only side wall 20 is described in detail herein, it being understood that the side wall 22 is formed with the identical structure and functions in the same manner. The side wall 20 includes a substantially vertically oriented curb reveal 26 which extends from the bottom wall 14 to a horizontally extending ledge or step 28 best shown in FIG. 2. The horizontal extent of the step 28 is preferably on the order of about 1½ inches measured in the direction from the outer edge of curb reveal 26 toward the hollow interior 24 of barrier unit 10.

Extending upwardly at an acute angle from the step 28 is an intermediate section 30 which terminates at a vertically extending upper section 32. The upper section 32, in turn, extends from the intermediate section 30 to the top wall 12 of barrier 10 which is formed with a pair of fill holes 33 preferably having a diameter in the range of about 3-4 inches. In the presently preferred embodiment, a number of stabilizers 34 are integrally formed in the intermediate section 30, at regularly spaced intervals between the end walls 16, 18. Each stabilizer 34 includes a base 36 and opposed sides 38 and 40. The base 36 of each stabilizer 34 is coplanar with the step 28 and is supported by an internally located support 42 shown in phantom lines in FIG. 4. The sides 38, 40 of each stabilizer 34 taper inwardly, toward one another, from the base 36 to a point substantially coincident with the uppermost edge of intermediate section 30 where the upper section 32 of side wall 20 begins. In the presently preferred embodiment, a through bore 44 extends from the base 36 of one or more of the stabilizers 34, through the internal support 42 and out the bottom wall 14 of barrier 10. Each of these through bores 44 mount an eyebolt 156, as described in more detail below in connection with a discussion of FIG. 16.

As shown in FIG. 3, a post boot 50 is formed at the bottom wall 14 of barrier 10, in alignment with each fill hole 33, to receive and support the bottom portion of a second eyebolt 160 which is inserted through the fill hole 33 as described in more detail below in connection with a discussion of FIG. 17. The top wall 12 is also formed with an internally extending seat 74 adapted to mount a warning light 230 which preferably flashes on and off to alert vessels of the presence of the barrier units 10. See FIGS. 16 and 17.

Each end wall 16 of barriers 10 is formed with an internally extending recess 48 near the bottom wall 14, which receives an outwardly protruding extension 52 formed on the end wall 18 of an adjacent barrier 10. The upper portion of end wall 16 is formed with a slot 56, and the upper portion of end wall 18 is formed with a slot 58. Each slot 56, 58 has an inner, generally cylindrical-shaped portion 59 and a narrower, substantially rectangular-shaped portion 61 at their respective end walls 16, 18. The slots 56, 58 extend from the top wall 12 downwardly to a point near the juncture of the upper section 32 and intermediate section 30.

When two barrier units 10 and 10' are oriented end-to-end, with the end wall 16 of one barrier 10 abutting the end wall 18' of an adjacent barrier 10', the slots 56, 58 collectively form a barbell-shaped locking channel 60 depicted in phantom in FIG. 3. This locking channel 60 receives a coupler 62 having cylindrical ends 64, 66 and a rectangular center section 67, which is removably insertable therein and extends substantially along the entire length of the locking channel 60. The cylindrical ends 64, 66 of coupler 62 pivot within the correspondingly shaped cylindrical portions 59, 59' of slots 56, 58', so that one barrier unit 10 can be pivoted with respect to an adjacent barrier 10'. Additional details and discussion on the structure for connecting adjacent barriers 10 to one another is provided below with reference to a description of FIGS. 16 and 17.

Each of the barrier units 10 further include a pair of hollow channels 68 and 70 are located within the hollow interior 24 of barrier unit 10 and extend between the side walls 20, 22. A portion of both channels 68, 70 is located in the intermediate section 30 of each side wall 20, 22, and extends partially into the upper sections 32 thereof. The two channels 68, 70 are positioned in the spaces between the three stabilizers 34 formed in the side walls 20, 22, and provide added internal support to the barrier 10 so that it retains its shape when filled with a ballast material. Each of the channels 68 and 70 define a pass-through hole or opening 72 adapted to receive the tines of a forklift truck to permit handling of the barriers 10. Additionally, the top wall 12 of each barrier unit 10 is formed with a seat 74.

Flotation of Barrier Units

Figure 5:
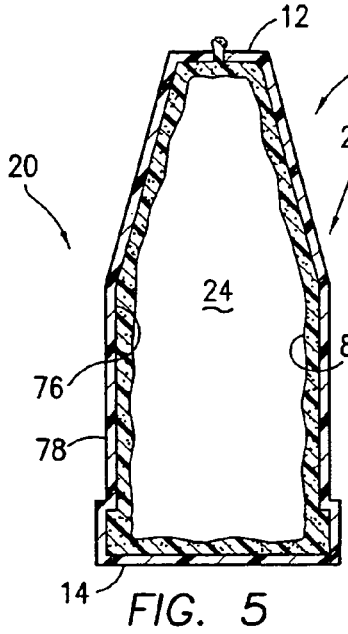
FIG. 5 is a cross sectional view taken generally along line 5-5 of FIG. 4.

As noted above, the barrier units of this invention are intended for use in marine applications to provide enhanced security for vessels and other assets when docked at port. It has been found that into the molding process which forms the barrier units 10, as well as during installation and use of same, cracks or other surface irregularities in the plastic forming the barrier units 10 can result in leakage of water in the hollow interior 24. With reference to FIG. 5, in one preferred embodiment of this invention structure is provided to allow the barrier units 10 to float by resisting leakage of water into the hollow interior 24 and by providing enhanced buoyancy of the barrier units 10. Each of the walls 12, 14, 16, 18, 20 and 22 of a barrier unit 10 is formed with an inner surface 76 located within the hollow interior 24 and an exterior, outer surface 78. These inner surfaces 60 receive a foam layer 84 having a thickness in the range of about 0.5 to 6 inches. The remainder of the hollow interior 24 is empty. The foam layer 84 is effective to seal the inner surface 60 of each wall and substantially prevent leakage of water into the hollow interior 24. Additionally, the foam layer 84 is puncture resistant, particularly as its thickness is increased, and therefore resists leakage even if the plastic walls of the barrier are damaged during installation or use.

The method of forming the barrier unit 10 with the foam layer 84 forms no part of this invention, and is therefore not discussed in detail herein. Generally, a rotational molding process is employed in which a polyethylene resin and polyethylene foaming pellets are combined in a mold to form the completed barrier. Each of the walls 12, 14, 16, 18, 20 and 22 is therefore formed of a high density polyethylene using this molding technique, preferably having a thickness on the order of about 0.25 inches. One type of polyethylene resin suitable for forming the plastic walls of the barrier 10 are commercially available from ExxonMobil Chemical under the trademark "PAXON," Type Numbers 7004 and 7204 rotational molding resins.

One foam material which can be employed in the rotational molding process noted above to form the foam layer 64 is commercially available from Equistar Chemicals, Inc. of Houston, Tex. under the trademark "PETROTHENE." A structural foam, semi-rigid foam or flexible PETROTHENE foam may be employed in the barrier 10 of this embodiment of the present invention, whose properties and type numbers are as follows:

| Property | Nominal Value | Units |
|---|---|---|
| MSTR005-Structural Foam | | |
| Density | 7 | $lb/ft^3$ |
| Compressive Modulus | 800 | psi |
| Shrinkage (w/MSTR003, 4 skin) | 0.010-0.015 | in/in |
| Thermal Conductivity (k) | 0.435 | BTU in/hr $ft^2$ ° F. |
| MSTR008-Semi-Rigid Foam | | |
| Density | 4 | $lb/ft^3$ |
| Compressive Modulus | 180 | psi |
| Shrinkage (w/MSTR003, 4 skin) | 0.010-0.015 | in/in |
| Thermal Conductivity (k) | 0.384 | BTU in/hr $ft^2$ ° F. |
| MSTR007-Flexible Foam | | |
| Density | 2 | $lb/ft^3$ |
| Compressive Modulus | 35 | psi |
| Shrinkage (w/MSTR003, 4 skin) | 0.010-0.015 | in/in |
| Thermal Conductivity (k) | 0.357 | BTU in/hr $ft^2$ ° F. |

In most instances it is contemplated that a semi-rigid foam would be employed to form the foam layer 84, such as PETROTHENE Type No. MSTR008. If additional structural rigidity is required, a denser foam with increased compressive modulus may be used such as PETROTHENE Type No. MSTR005. Further, the overall thickness of the foam layer 84 can be controlled in the molding process to increase or decrease the rigidity of the barrier 10, i.e., the thicker the foam layer 84 the more rigid the walls 12-22.

Figure 6:
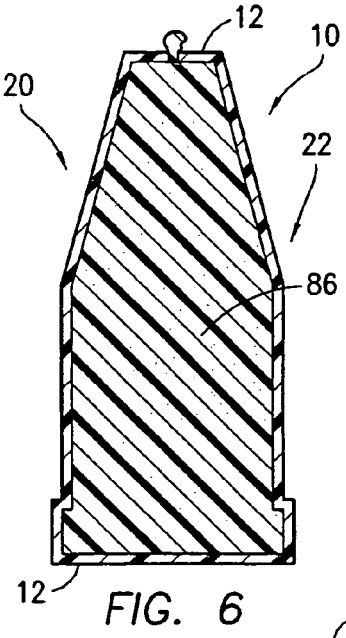
FIG. 6 is a cross sectional view similar to FIG. 5 except of an alternative embodiment in which the barrier unit is completely filled with a foam material.

Referring now to FIG. 6, a further embodiment of this invention is shown in which the hollow interior 24 of the barrier 10 is completely filled with a foam material to form a solid foam body 86. One presently preferred foaming material is a two-component polyether-based, low density pour-in-place urethane foam commercially available from North Carolina Foam Industries of Mount Airy, N.C. under the name "NCFI Low Density Pour System 31-120." The resin properties and reaction properties of this material are as follows:

Typical Resin Properties

| | 31-120R | 31-120A |
|---|---|---|
| Viscosity @ 72° F. | 500 cps | 200 cps |
| Weight Per Gallon | 9.5 lbs. | 10.2 lbs. |
| Appearance | amber liquid | brown liquid |
| Shelf Life | 6 months | 6 months |
| MIX RATIO: | | |
| Ratio By Weight | 100 parts | 107 parts |
| Ratio By Volume | 100 parts | 100 parts |

Typical Reaction Properties

| | Hand Mix @ 72° F. |
|---|---|
| Cream Time, seconds | 32 |
| Gel Time, seconds | 140 |
| Rise Time, seconds | 210 |
| Density (FRC) | 1.9 pcf |

Preferably, such foam material is be introduced in liquid form into the hollow interior 24 of a barrier unit 10 through one of the fill holes 33, and then allowed to cure in situ thus filling up the entire volume of the hollow interior 24. Not only is the buoyancy of the barrier units 10 enhanced by a continuous body of foam material 86, but the structural integrity thereof is improved since cracks, punctures or other damage to the outer, plastic skin of the barrier units 10 would not affect the ability of same to remain afloat in the water.

As noted above, the empty weight of a barrier unit 10 is about 75 to 135 pounds, and the addition of a foam layer 84 or continuous foam body 86 adds little to the overall weight. Additionally, although the barrier units 10 readily float in the water, it is important that they be maintained in an upright position for maximum visibility, i.e. with the bottom wall 14 and a portion of the side walls 20, 22 submerged, and the top wall 12 out of the water.

Figure 15:
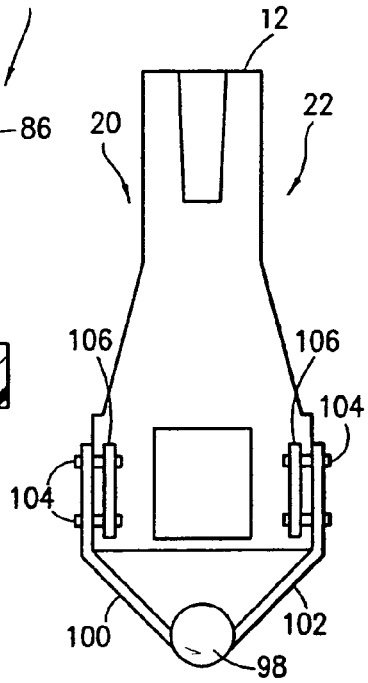
FIG. 15 is a schematic, end view of a barrier unit having a ballast weight extending below the bottom wall.
Figure 13:
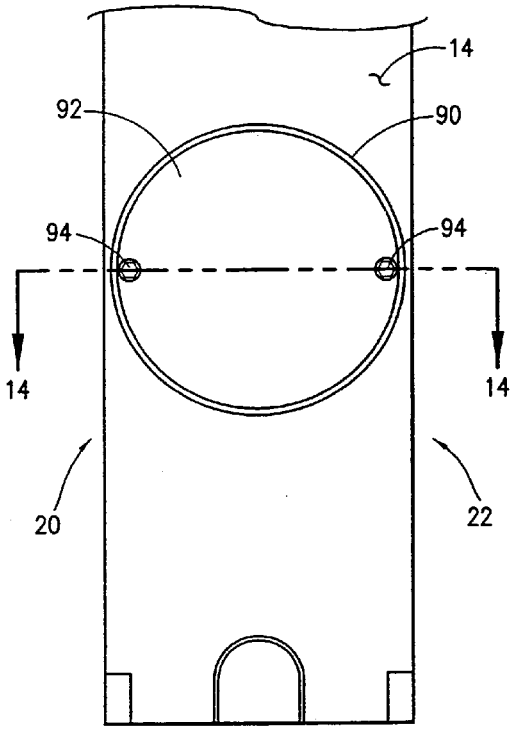
FIG. 13 is a bottom view of the barrier unit shown in FIG. 2.
Figure 14:
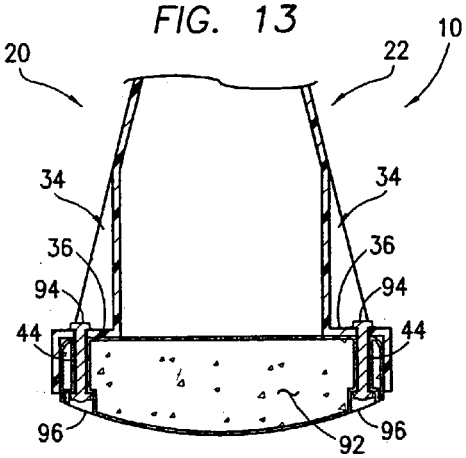
FIG. 14 is a cross sectional view taken generally along line 14-14 of FIG. 13.

Referring now to FIGS. 13-15, alternative embodiments are illustrated of a ballast weight to maintain the barrier units 10 in the upright position. In the embodiment of FIGS. 13 and 14, a recess 90 is formed in each barrier unit 10 which extends inwardly from the bottom wall 14 into the hollow interior 24. The recess 90 is located at the center of the barrier unit 10, immediately beneath the base 36 of the center stabilizer 34 formed in the side walls 20 and 22. A ballast weight 92 is mounted within the recess 90 by a pair of bolts or pins 94, each extending from a seat 96 formed in the ballast weight 92 and though the through bore 44 formed in the base 36 of the center stabilizer 34. In this embodiment, the ballast weight 92 is substantially entirely received within the recess 90 and protrudes only slightly beyond the bottom wall 14 of the barrier unit 10. Preferably, the ballast weight 92 is formed of concrete encased with rubber or other non-abrasive material.

In an alternative embodiment depicted in FIG. 15, a ballast weight 98 is suspended below the bottom wall 14 of the barrier unit 10 by a pair of chains or cables 100 and 102. One end of each cable 100, 102 is embedded in the ballast weight 98, preferably of the same type as ballast weight 92, and the opposite end of each cable 100, 102 is mounted to the side walls 20, 22, respectively of the barrier unit 10 by any suitable fasteners 104 which connect to an internal plate 106.

Barrier Units of FIGS. 7-12

Figure 7:
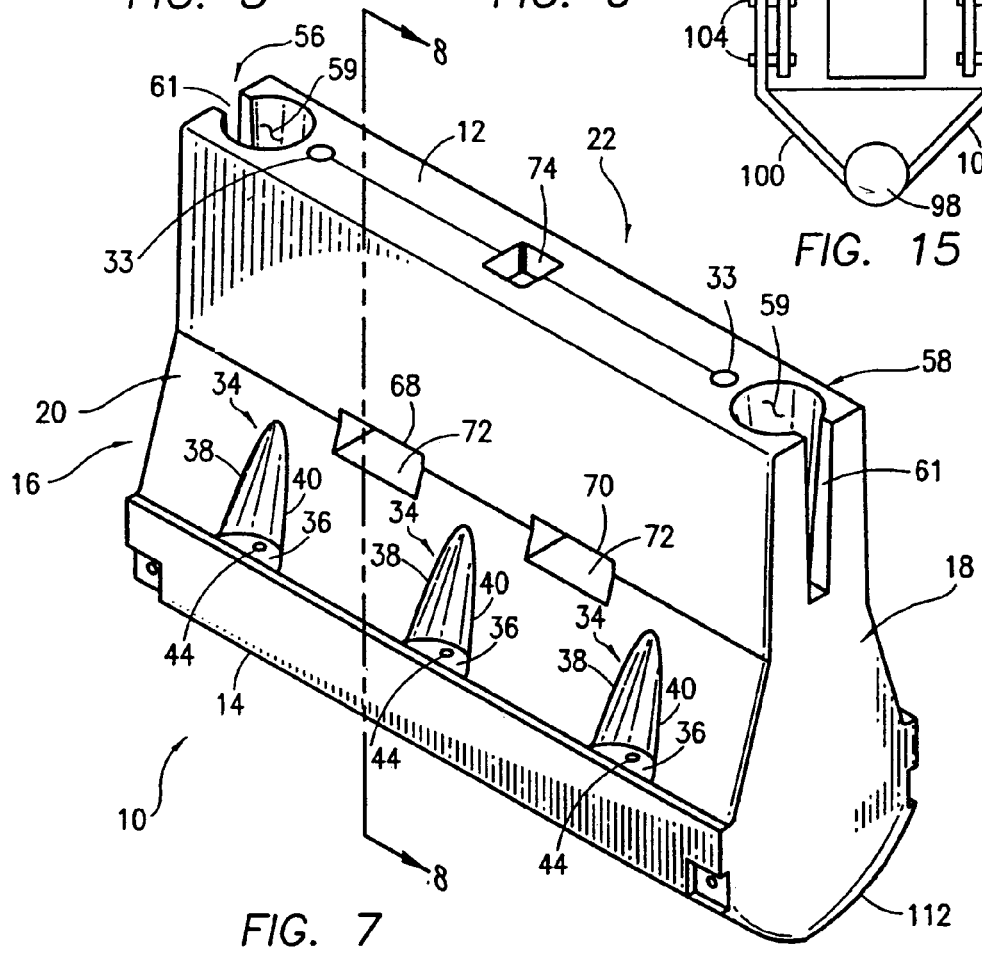
FIG. 7 is a perspective view of a barrier unit similar to that depicted in FIGS. 2-4, except with a hull-shaped bottom wall.
Figure 8:
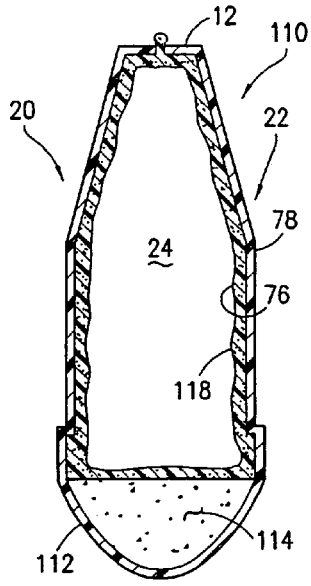
FIG. 8 is a cross sectional view taken generally along line 8-8 of FIG. 7.
Figure 9:
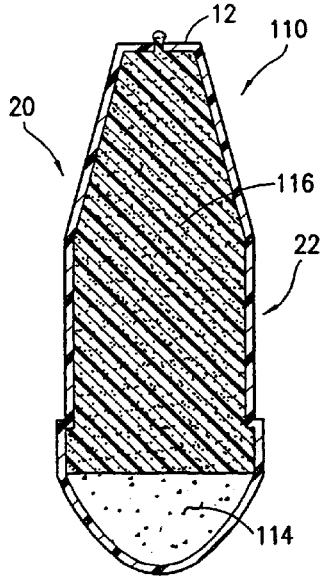
FIG. 9 is a cross sectional view similar to FIG. 9 except of an alternative embodiment in which the barrier unit is completely filled with a foam material.

Referring initially to FIGS. 7-9, an alternative embodiment of a barrier unit 110 according to this invention is shown. The barrier unit 110 is similar to the barrier unit 10, and the same reference numbers are used to indicate like structure in the devices 10 and 110. To enhance stability in the water, and further assure that the barrier unit remains in the upright position, the barrier unit 110 of this embodiment is formed with a bottom wall 112 having a shape similar to the hull of a vessel. The other walls of the barrier unit 110 have the same construction, and are formed of the same material, as the walls 12-22 of barrier unit 10 described above.

One other modification of the barrier unit 110 compared to barrier unit 10 involves the ballast weight. Instead of attaching a ballast weight on the exterior of the barrier unit 110, as in the embodiment of FIGS. 13-15, concrete, crushed stone or other heavy material is introduced into the hollow interior 24 through the fill holes 33 to form a ballast layer or weight 114 along the bottom wall 112. The ballast layer 114 may extend part way upwardly along the side walls 20, 22, if desired, to provide additional weight.

For the same reasons discussed above in connection with the barrier unit 10, it is preferred to incorporate a foam layer or core within the interior of barrier unit 110. As best seen in FIG. 9, in one embodiment a body of foam material 116 is provided which is identical to the foam body 66 discussed above in connection with FIG. 6, except that the body of foam material 116 begins at the top surface of the ballast layer 114 and fills the remainder of the volume of the hollow interior 24. Alternatively, a foam layer 118 is formed along the walls 12, 16, 18, 20, 22 and bottom wall 112, in the same manner as described above in connection with a discussion of FIG. 5, but with the ballast layer 114 filling the area along the bottom of the barrier unit 110. See FIG. 8.

Figures 10, 11, 12:
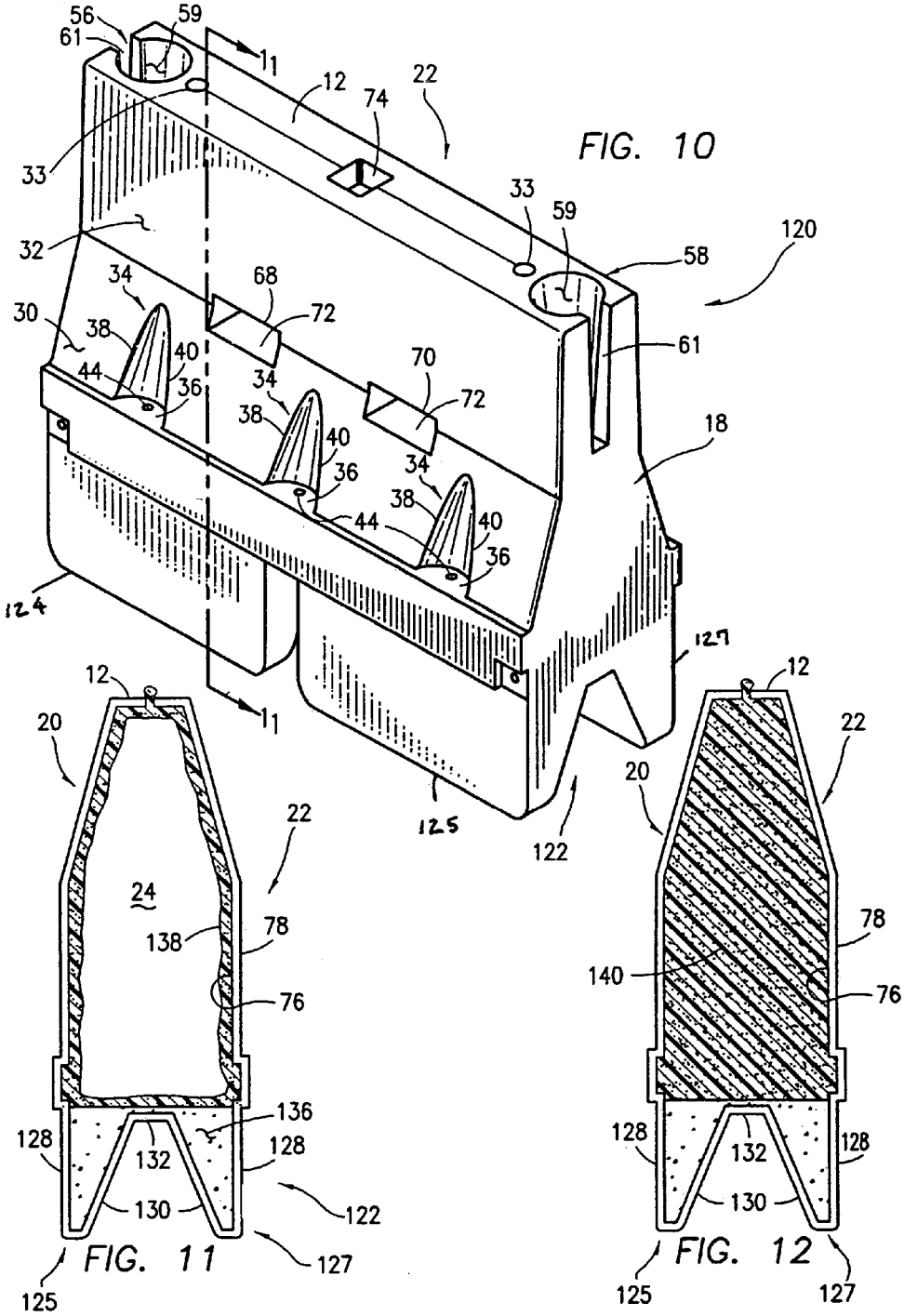
FIG. 10 is a perspective view of an alternative embodiment of a barrier device according to this invention in which the bottom wall is formed with spaced pontoons.
FIG. 11 is a cross sectional view taken generally along line 11-11 of FIG. 10.
FIG. 12 is a cross sectional view similar to FIG. 11 except of an alternative embodiment in which the barrier device is completely filled with a foam material.

An alternative embodiment of a barrier unit 120 according to this invention which employs structure for stabilizing the barrier, and an internal ballast weight, is shown in FIGS. 10-12. In this embodiment, the bottom wall 122 of the barrier unit 120 is formed with a pair of spaced pontoons 124 and 125 extending downwardly from the side wall 20, and a pair of spaced, second pontoons 126 and 127 extending from the side wall 22. As depicted in FIG. 10, the pontoons 124 and 125 are spaced from one another in a longitudinal direction, e.g., between the end walls 16, 18, as are the pontoons 126 and 127. The purpose of this separation is to reduce drag on the barrier unit 120 imposed by tides, current and other water movement. Each of the pontoons 124-127 has a generally vertical wall 128, with the barrier 120 in the position depicted in the Figs., and an angled wall 130 extending from the vertical wall 128 toward the center of the barrier unit 120. A small space 132 is formed between the angled walls 130 of the two pontoons 124, 126 at the barrier center, as shown. Preferably, each pontoon 124 and 126 has a rounded end 134 at the juncture of the vertical and angled walls 128, 130.

The purpose of the spaced pontoons 124 and 126 is to provided added stability to the barrier unit 120 in the water. Additionally, a ballast weight 136 consisting of material such as concrete, gravel, sand or the like is added within the hollow interior of each pontoon 124-127, i.e., the space defined by the volume between the respective walls 128, 130 of the pontoons 124-127. If desired, additional ballast material can be introduced into the hollow interior 24 of the barrier unit 120 above the level of the bottom wall 122.

As shown in FIGS. 11 and 12, the barrier unit 120 of this embodiment is also preferably formed with either a foam layer or core of foam material as in the barrier unit 110 described above in connection with a discussion of FIGS. 7-9. As shown in FIG. 11, a foam layer 138 is formed along the walls 12, 16, 18, 20 and 22 of the barrier unit 120 at a location above the ballast weight 136. In FIG. 12, a solid foam body 140 is provided which is essentially identical to the body of foam material 116 depicted in FIG. 9.

Connection of FIGS. 2-12 Barriers

Figure 16:
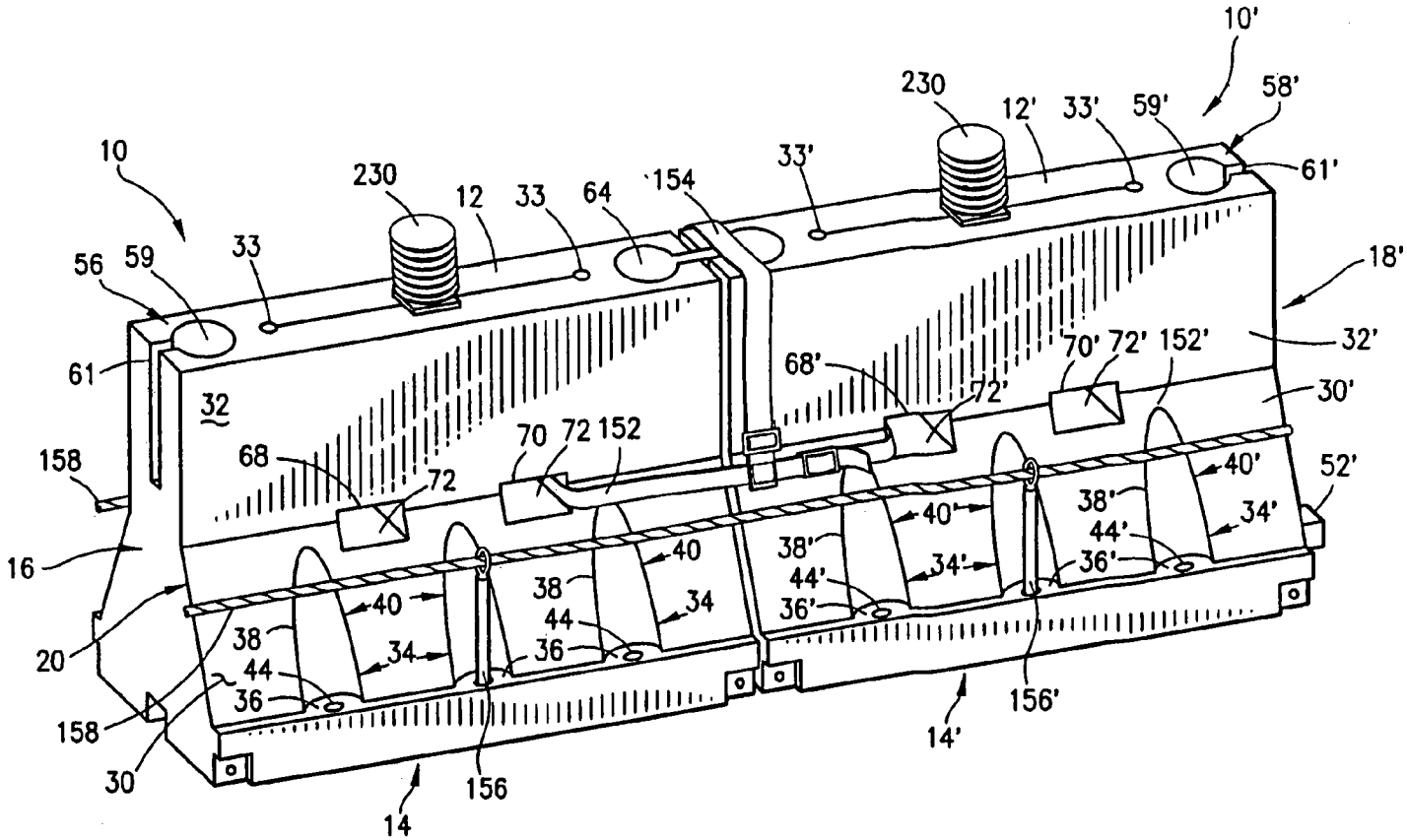
FIG. 16 is a view of two barrier units connected end-to-end carrying a cable with eyebolts mounted at the curb reveal of the barrier devices.

Another aspect of this invention involves the connection of adjacent barrier units 10 together to form a barrier wall 150 as schematically depicted in FIG. 1. Such connecting structure includes, in alternative embodiments, means for mounting the barrier units 10 together at their opposed ends, and means for supporting a cable, rope, chain or other substantially continuous elongated connector along each the barrier units 10 when oriented end-to-end. Two barrier units 10 and 10' are depicted in FIGS. 3, 16 and 17, which are identical in structure and function. The same reference numbers are therefore used to identify like structure, with the addition of a "'" to the numbers associated with barrier 10'.

As noted above, when two barrier units 10 and 10' are oriented end-to-end, with the end wall 18 of one barrier 10 abutting the end wall 16' of an adjacent barrier 10', the slots 56, 58 collectively form a barbell-shaped locking channel 60. See also FIG. 4. A coupler 62 is inserted within the locking channel 60 to pivotally interconnect the adjacent barrier 10, 10'. In each of the embodiments of FIGS. 16 and 17, an endless, horizontally oriented strap 152 is extended through the opening 72 of barrier 10 and through the opening 72' of the adjacent barrier 10'. This strap 152 provides additional end-to-end support to resist disengagement of the barriers 10, 10'. The horizontal strap 152 also connects to a vertically extending strap 154 which is looped over the coupler 62 inserted within the locking channel 60. One end of the vertical strap 154 is connected to the horizontal strap 152 along the side walls 22, 22' of the barrier units 10, 10', and the opposite end of vertical strap 154 mounts to the horizontal strap 152 on the opposite side walls 20, 20' of barrier units 10, 10' (not shown). The purpose of the vertical strap 154 is to maintain the coupler 62 in place within the locking channel 60.

Figure 17:
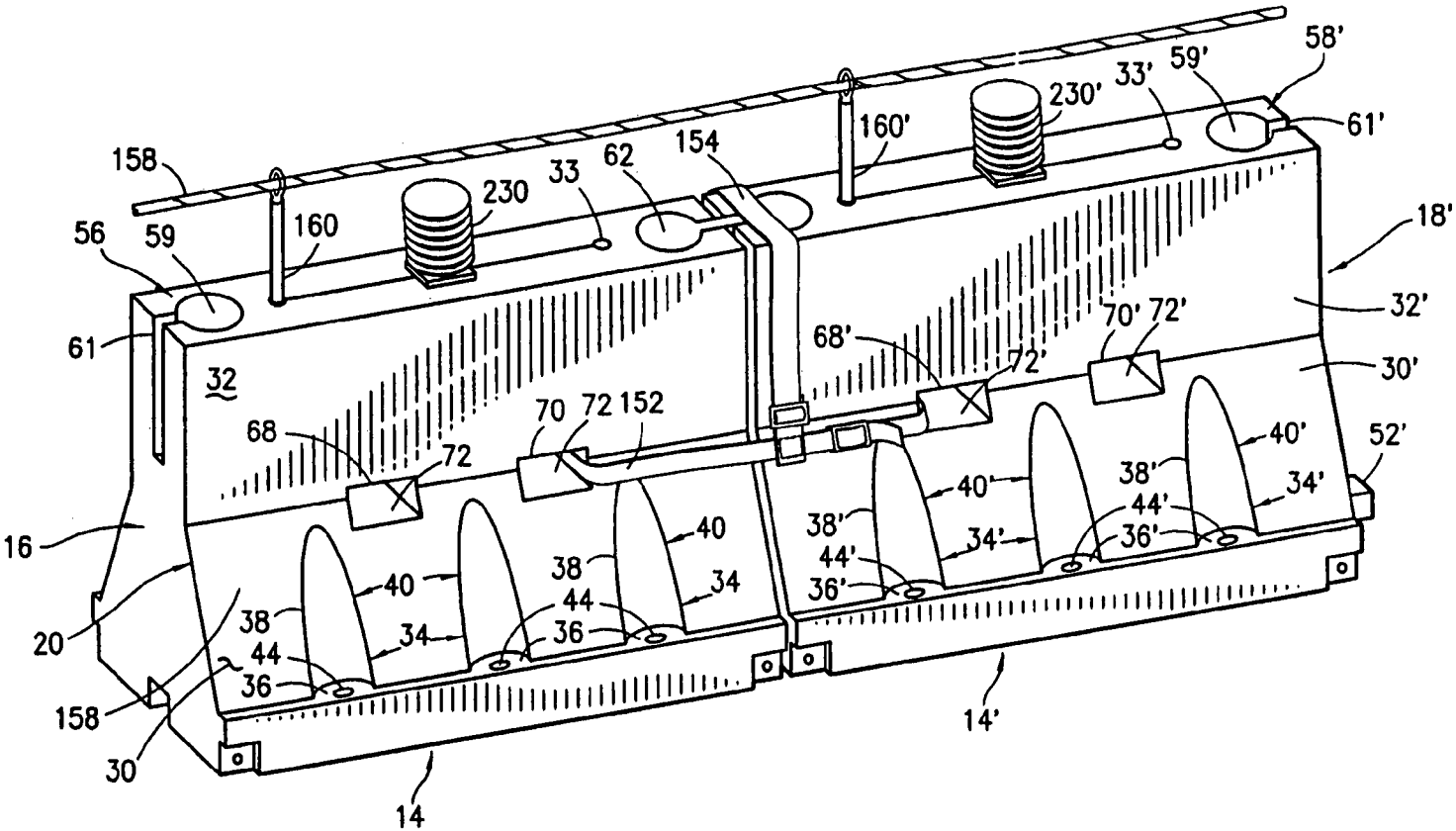
FIG. 17 is a view similar to FIG. 16 except with the cable carried by eyebolts mounted at the top wall of the barrier devices.

In the embodiments of FIGS. 16 and 17, additional structure is provided to interconnect adjacent barrier units 10, 10', and to form the barrier wall 150. Referring initially to FIG. 16, at least one eyebolt 156 is extended though a through bore 44 in the barrier unit 10, and an eyebolt 156' is carried by a through bore 44' in barrier device 10'. The eyebolts 156, 156' are mounted in place by a nut (not shown). A cable, chain, rope or other elongated member 158 is extended through the eye of the eyebolts 156, 156' and, preferably, is mounted at opposite ends to a permanent structure such as a pier 157, dock other permanent structure as schematically depicted in FIG. 1. The eyebolts 156, 156' are effective to maintain the elongated member 158 out of the water in a position to engage the hull, or at least the screw, of an oncoming vessel. It is contemplated that if such construction does not stop a vessel, the elongated member 158 will impede it's progress sufficiently to allow time for defensive action by vessels in the port.

Referring now to FIG. 17, an alternative means of mounting the elongated member 158 is shown. In this embodiment, eyebolts 160 and 160' are mounted within one of the fill holes 33, 33' of respective barrier devices 10, 10', with the end of the eyebolts 160, 160' being secured in the post boot 50, 50' with any suitable fastener (not shown). See also FIG. 3. The eye of each eyebolt 160 receives and supports the elongated member 158 in position above the top wall 12 of the barrier units 10, 10' for the same purposes as described above in reference to a discussion of FIG. 13. The barriers 10, 10' are otherwise identical to those illustrated in FIG. 16.

It should be understood that while the structure noted above for interconnecting adjacent barriers has been described with reference to barrier units 10 and 10', adjacent barrier units 110, 110' and 120, 120' are interconnected in the same fashion.

Figure 18:
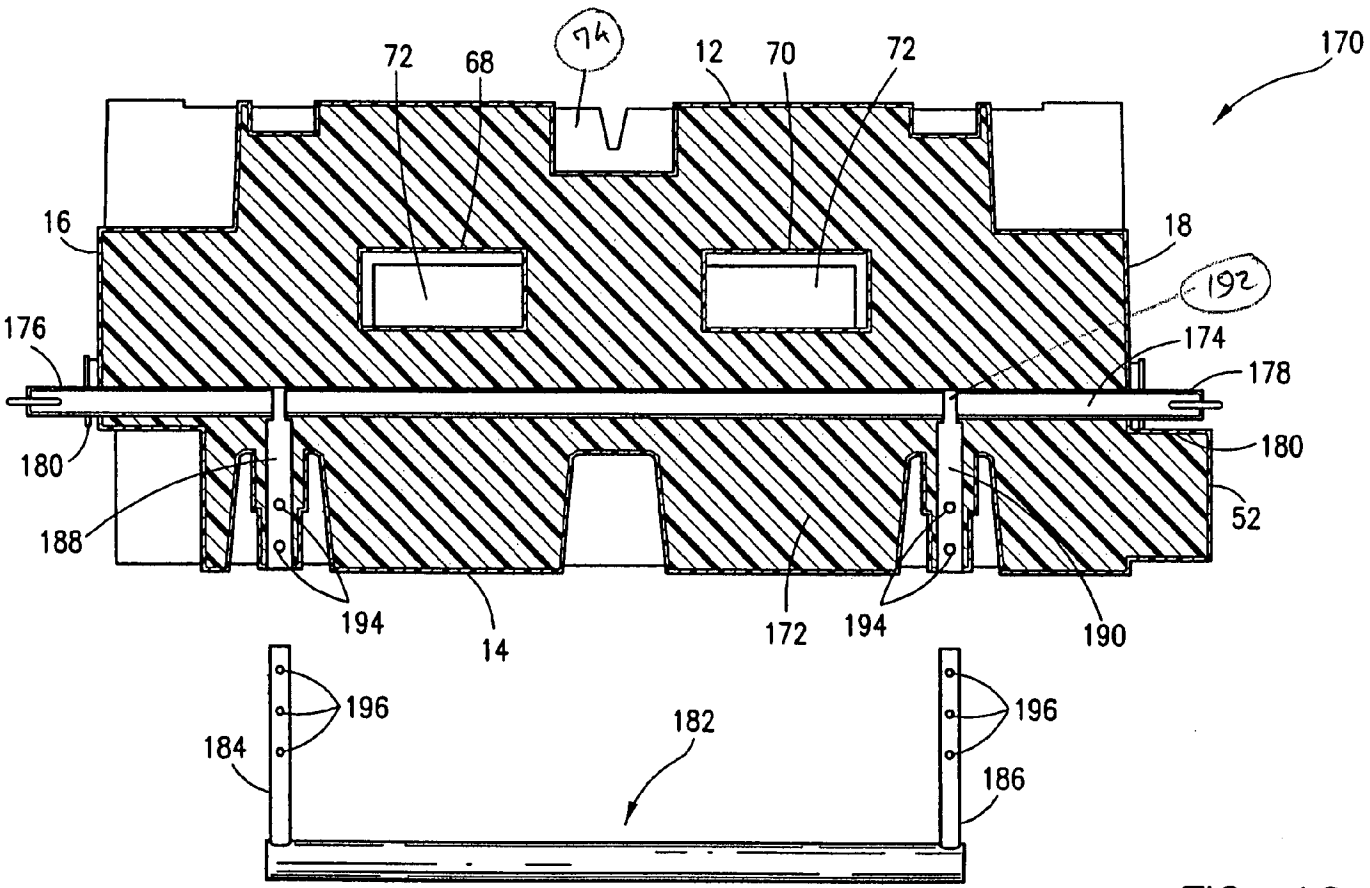
FIG. 18 is a cross sectional, elevational view of an alternative embodiment of a barrier unit incorporating an adjustable height ballast weight.
Figure 19:
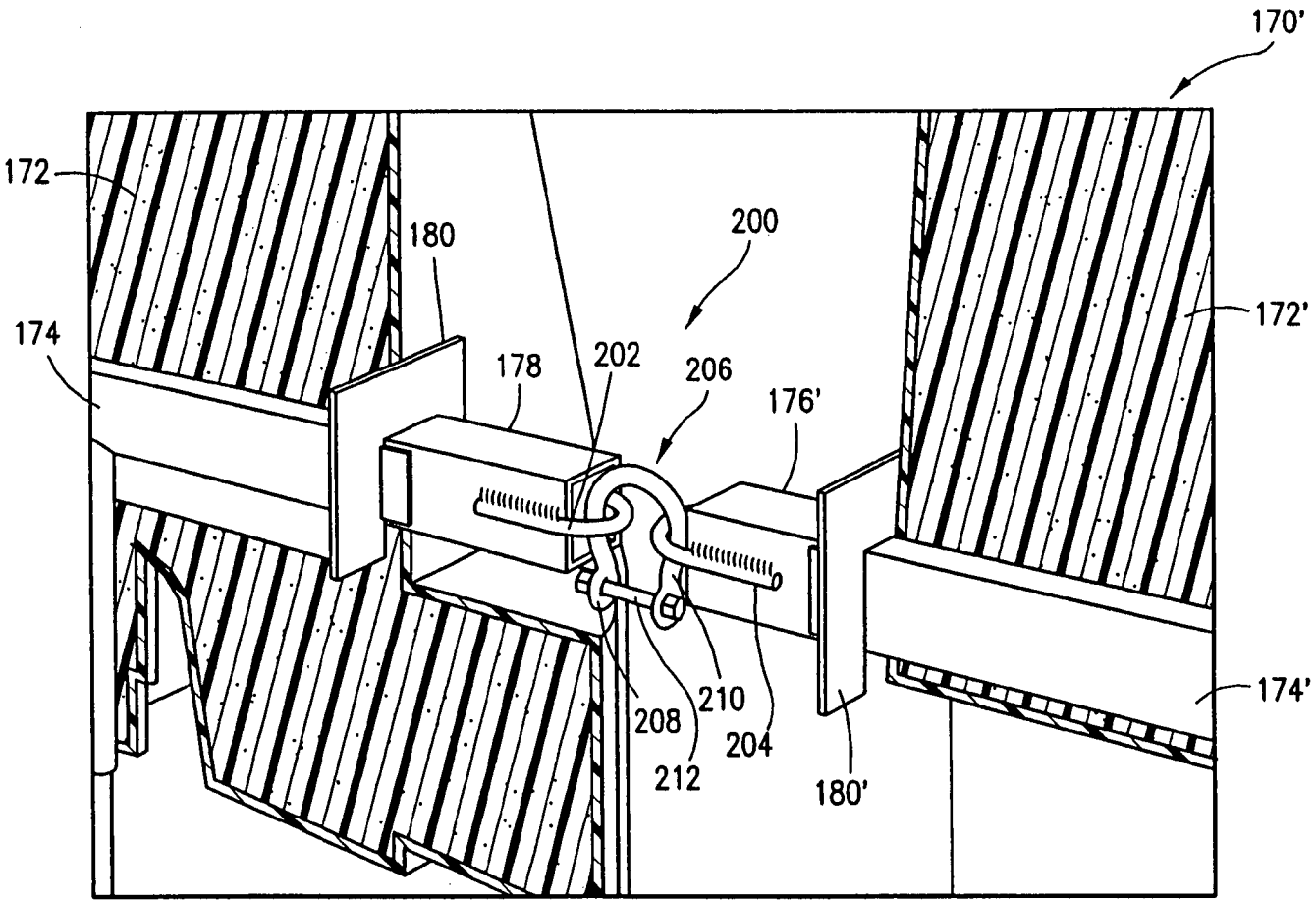
FIG. 19 is a view of the mounting structure for connecting two barriers of the type illustrated in FIG. 18 end-to-end.

Barrier Unit of FIGS. 18 and 19

Referring now to FIGS. 18 and 19, a still further embodiment of a barrier unit 170 is illustrated which similar in construction to the barrier unit 10 except primarily for the ballast weight and means for connecting adjacent barriers together. Structural elements of the barrier unit 170 which are common to that of barrier unit 10 are given the same reference numbers in FIGS. 18 and 19.

In the presently preferred embodiment, the entire hollow interior 24 of barrier unit 170 is filled with a foam material body 172 comprised of the same foam as described above in connection with a discussion of FIGS. 6, 9 and 12. A tube, pipe 174 of other hollow member extends through the interior 24 of the barrier unit 170, at a location above the extension 52, which has one end 176 protruding from the end wall 16 and the opposite end 178 protruding from the end wall 18. A retention plate 180 is mounted to each end 176, 178 of the pipe 174 at the point where they extend through end walls 16, 18, respectively. The retention plate 180 assists in retaining the pipe 174 in position within the barrier interior 24.

An elongated ballast weight 182 is suspended beneath the bottom wall 14 of barrier unit 170 by a pair of mounting arms 184 and 186. Each of the mounting arms 184, 186 is telescopically received within a sleeve 188, 190, respectively, connected to the pipe 174. The sleeves 188, 190 extend from the bottom wall 14 of the barrier unit 170 into the interior 24, and are mounted to the pipe 174 by a collar 192 or other suitable fastener. As shown in FIG. 18, spaced holes 194 are formed in each of the sleeves 188, 190 which align with spaced openings 196 formed in the mounting arms 184, 186. One of the openings 196 in the mounting arms 184, 186 is aligned with a hole 194 in the sleeves 188, 190 to receive a pin or key (not shown) in order to connect the two together. The provision of a number of spaced holes 194 permits vertical adjustment of the position of the ballast weight 182 relative to the bottom wall 14 of the barrier unit 170, as desired. It is contemplated that a warning light (not shown) or other equipment could be mounted to the seat 74 and other locations along the top wall 12 of the barrier unit 170. The greater the quantity, weight and height of such equipment, the greater the tendency of the barrier unit 170 to tip over on its side or upside down. This tendency is resisted by the ballast weight 182, and its position is adjusted downwardly with respect to the bottom wall 14 of the barrier unit 170 to increase its effectiveness as a counterweight. Furthermore, the overall mass of the ballast weight 182 can be increased, if necessary, to ensure the barrier unit 170 remains in an upright position.

The ballast weight 182 is preferably a tube, pipe or other hollow member which is filled with concrete, gravel or other heavy material. In addition to stabilizing the barrier unit 170, the shape and location of the ballast weight 182 resists the effects of current, tides and other water movement. This aids in stabilizing the barrier unit 170 in the water, and reduces stress on the coupling elements which interconnect adjacent barriers 170, 170'. It is contemplated that the ballast weight 182, and/or its mounting arms 184, 186, could be utilized to mount a variety of equipment such as listening devices, motion sensors, explosive devices, netting and the like (not shown).

Referring now to FIG. 19, portions of two barrier units 170 and 170' are shown with the coupling element 200 which interconnects them. In the presently preferred embodiment, a U-shaped bracket 202 is welded or otherwise permanently affixed to the end 178 of barrier unit 170, and a second bracket 204 is connected in the same manner to the end 176' of the barrier unit 170'. As depicted FIG. 19, a portion of each bracket 202, 204 protrudes from respective ends 178 and 176' of the barrier units 170, 170' in position to receive and mount a shackle 206. One arm 208 of the shackle 204 extends into the bracket 202 and its other arm 210 is received within the bracket 204. The arms 208, 210 are connected by a bolt 212 as shown. The coupling arrangement for the barrier units 170, 170' provides a secure connection, and the curved portion of the U-shaped brackets 202, 204 to which the shackle 204 is connected allow for at least limited pivotal motion of one barrier unit 170, 170' relative to the other.

In forming the barrier wall 150, whether employing the barrier units 10, 110, 120 or 170, it is preferred to include a series of platforms 220 at selected intervals each carrying two or more barrier units. For purposes of the present discussion, and with reference to FIG. 20, a platform 220 is shown with three barrier units 10, 10 and 170 in a side-by-side position to be received by the platform 220. The platform 220 has four interconnected sides 222, 224, 226 and 228, and a pair of cross braces 231 and 232. The cross braces 231 and 232 are mounted to the bottom of the two opposed sides 222, 226 and are spaced from one another a distance somewhat less than the length of the barrier units 10, 10 and 170, as measured between their end walls 16, 18. Each of the cross braces 231 and 232 mounts upright posts 234 which are positioned to be inserted within the through bores 44 on opposite sides of each barrier 170, and then connected thereto by nuts 236, when the barriers 170 are placed within the platform 220 atop the cross braces 231 and 232.

Figure 20:
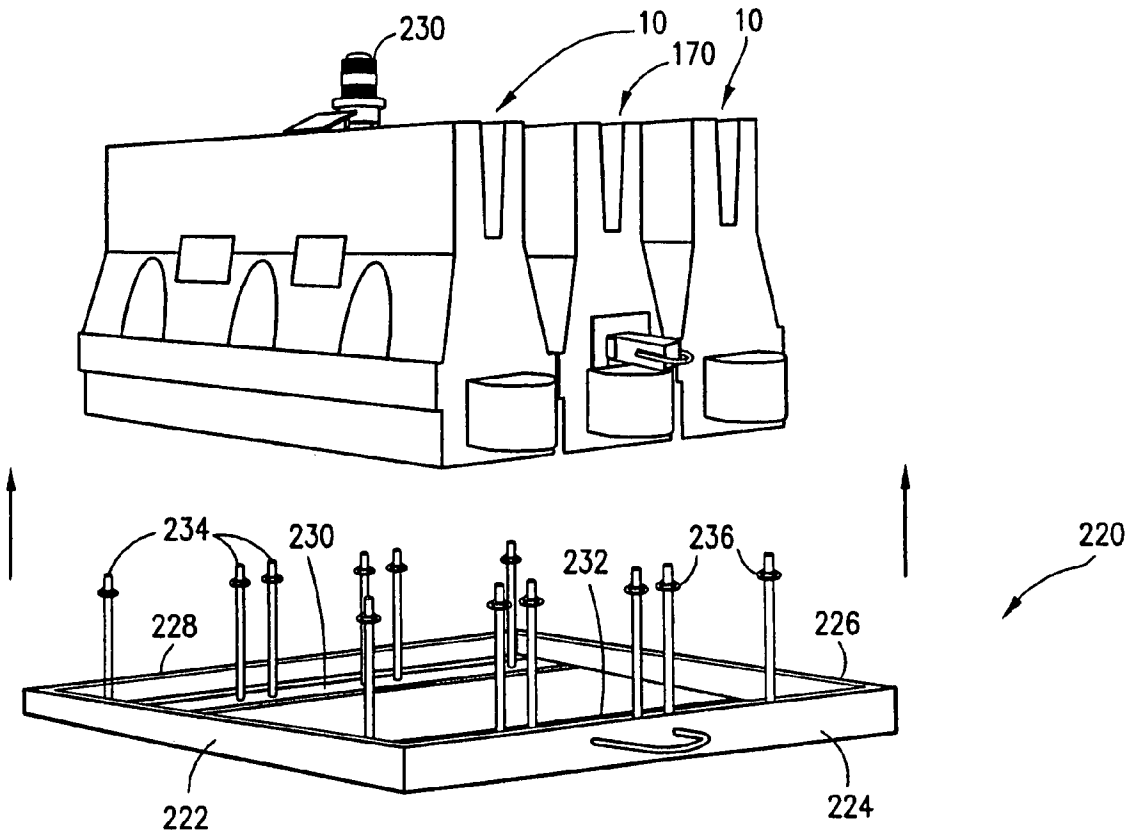
FIG. 20 is a disassembled, perspective view of a platform designed to receive and support three barrier units of the type shown in FIGS. 18 and 19.

One purpose of the platform 220 is to add overall stability to the barrier wall 150. As noted above, a number of platforms 220 are located at spaced intervals along the length of the barrier wall 150, and with three side-by-side barriers 10, 10 and 170 within each platform 220 increased resistance is provided to overturning of individual barriers 170. Additionally, as schematically depicted in FIG. 20, a warning light 230 can be mounted to one or more of the barrier units 10, 10 or 170 on the platforms 220 to increase visibility of the entire barrier wall 150. Preferably, the coupling element 200 associated with barrier unit 170 carried by the platform 220 is used to connect opposite ends of the platform 220 to adjacent barriers 170 in the barrier wall 150.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A floating barrier unit, comprising:

a housing having a hollow interior, said housing being formed in the shape of a highway barrier including a top wall, a bottom wall, opposed side walls and opposed end walls, each of said side walls having a curb reveal connected to said bottom wall, an intermediate section extending at an angle from said curb reveal, and an upper section connected between said intermediate section and said top wall;

a ballast weight located within said hollow interior of said housing, which, when said housing is placed in the water, is effective to assist in maintaining said bottom wall in the water and said top wall out of the water;

said hollow interior of said housing being at least partially filled with a foam material.

2. The floating barrier wall of claim 1 in which said bottom wall of said barrier unit is formed in the general shape of the hull of a vessel.

3. The floating barrier unit of claim 1 in which said housing has an inner surface located within said hollow interior, said inner surface mounting a layer of foam material.

4. The floating barrier unit of claim 3 in which said layer of foam material has a thickness in the range of about 0.5 to 6 inches.

5. A floating barrier wall, comprising:

a number of individual floating barrier units each including:

(i) a housing having a hollow interior, said housing being formed in the shape of a highway barrier including a top wall, a bottom wall, opposed side walls and opposed end walls, each of said side walls having a curb reveal connected to said bottom wall, an intermediate section extending at an angle from said curb reveal, and an upper section connected between said intermediate section and said top wall;

(ii) a ballast weight located within said hollow interior of said housing, which, when said housing is placed in the water, is effective to assist in maintaining said bottom wall in the water and said top wall out of the water;

(iii) said hollow interior of said housing being at least partially filled with a foam material;

a connecting device extending between adjacent barrier units which is effective to connect said floating barrier units end-to-end.

6. The floating barrier wall of claim 5 in which a recess is formed along each of said end walls extending from said top wall toward said bottom wall, said connecting device including a coupler having one end insertable within said recess in said end wall of one floating barrier unit and an opposite end insertable within said recess in said end wall of an adjacent floating barrier unit.

7. The floating barrier wall of claim 6 further including a strap which extends over said coupler to retain it in place within said recesses.

8. The floating barrier wall of claim 5 in which each of said floating barrier units is formed with at least one opening extending through said hollow interior from one of said side walls to the other side wall, said connecting device including a connector element extending from said at least one opening of one floating barrier unit to said at least one opening of an adjacent floating barrier unit.

9. The floating barrier wall of claim 8 in which said connector element is a strap which extends through said opening of each of two adjacent barrier units.

10. The floating barrier wall of claim 5 in which said connector device includes at least one mounting element connected to said housing of each barrier unit, and a connector element extending between and carried by said mounting elements of adjacent barriers, said mounting element comprising an eyebolt having one end secured to each side wall of said housing of each barrier unit and an opposite end formed with an eyelet.

11. The floating barrier wall of claim 10 in which said connector element is a cable extending through said eyelets of said eyebolts mounted to adjacent barrier units.

12. The floating barrier wall of claim 10 in which said mounting element is an eyebolt having one end connected within an opening formed in said housing of each barrier unit which extends from said top wall toward said bottom wall thereof, the other end of said eyebolt having an eyelet spaced from said top wall of said housing.

13. The floating barrier wall of claim 12 in which said connector element is a cable extending through said eyelets of said eyebolts mounted to adjacent barrier units.

14. The floating barrier wall of claim 5 in which said housing of each of said floating barrier units has an inner surface located within said hollow interior, said inner surface mounting a layer of foam material.

15. The floating barrier unit of claim 14 in which said layer of foam material has a thickness in the range of about 0.5 to 6 inches.

16. The floating barrier wall of claim 5 in which said bottom wall of each of said barrier units is formed in the general shape of the hull of a vessel.

* * * * *